United States Patent [19]

DiMartino

[11] 4,313,702

[45] Feb. 2, 1982

[54] CONTAINER CONSTRAINER SYSTEM

[75] Inventor: John M. DiMartino, Sayville, N.Y.

[73] Assignee: Line Fast Corporation, Holbrook, N.Y.

[21] Appl. No.: 109,786

[22] Filed: Jan. 7, 1980

[51] Int. Cl.[3] ..... B60P 3/06

[52] U.S. Cl. ..... 410/94; 410/121

[58] Field of Search ..... 410/94, 121, 143, 151; 114/75

[56] References Cited

U.S. PATENT DOCUMENTS

| | | | |
|---|---|---|---|
| 2,543,175 | 2/1951 | Kilgore | 410/151 |
| 2,766,704 | 10/1956 | McMahon | 410/151 |
| 3,132,603 | 5/1964 | Stough | 410/94 |
| 3,183,855 | 5/1965 | Adler | 410/143 |
| 3,251,489 | 5/1966 | Davidson | 410/79 |
| 3,606,842 | 9/1971 | Verbick | 410/94 |

*Primary Examiner*—Richard A. Bertsch

*Attorney, Agent, or Firm*—Robert A. Kelly

[57] ABSTRACT

This invention pertains to a removable constrainer for shipping containers whereby the holds of bulk carriers can be rapidly converted to container carriers by use of a bridge means inserted in between the ends of containers and having chocks mounted on the bridge to constrain lateral movement of the containers with respect to the bridge, the bridge being removably mounted on opposite walls of the hold of the vessel in which it is employed.

8 Claims, 3 Drawing Figures

CONTAINER CONSTRAINER SYSTEM

BACKGROUND OF THE INVENTION

The use of enclosed cargo containers having a rectangular parallelepiped shape has increased greatly in recent years. Such containers are easy to load and unload off carriers such as ships, trucks and cargo vessels. Many ships have been especially adapted to carry such containers. In such ships the cargo holds have frameworks adapted to receive and hold in position the containers while the ship is in transit. This class of vessel is called a container ship.

The cargo container usually come in 40-foot outside lengths with 8-foot outside widths. The outside height of the containers have varying dimensions ranging from about 8 feet to about 9 feet 6 inches. In conventional container storage aboard ships the containers are stowed 3 inches apart head to head and one and one half inches apart laterally. There also is normally about a one inch space between containers when they are stacked vertically. The containers have corner fittings built into each of the four corners of the containers. These corner fittings have openings on the three external faces thereof adapted to receive and removably engage with container interlocks which locks are used to connect the containers together. The locks also provide for uniform spacing between the containers.

A class of container interlocks has been developed to interlock the top corner fittings of horizontally adjacent containers with a rigid bridge affixed to the lock on each of the containers. In such cases the bridge can be an integral part of the fitting or it can be a separate piece which connects up with two or more interlocks. The interlocks of this class of locks are called bridge interlocks. In commercial use there are bridge interlocks which can interlock a top corner fitting of a container having a height of 8 feet with the top corner fitting of a container having a height of 9 feet 6 inches.

There is a large body of merchant ships called bulk carriers. In bulk carriers there are several large holds with no obstructions therein such as posts which would interfere with the onloading and offloading of bulk cargos such as grains, coal, iron ore, etc. At the present time the bulk carrier ships have a very limited utility as container carriers. If a bulk carrier carrying coal to Japan arrives there and offloads the coal it would be very desirable for it to be able to pick up a cargo to deliver in another port. Unfortunately in many instances there is no bulk cargo available for such ships to carry back to its home port or another port. Because of this many times bulk cargo ships must travel unloaded back to its home port. This is both costly and very wasteful of fuel.

To overcome this problem, bulk cargo shippers have tried to carry containers in their vessels. They have tried to employ conventional lashing methods to hold the containers in place. Generally they use a combination of container bridge interlocks and cable lashing to hold the containers in place. The use of such lashings has been time consuming and very costly. Furthermore there have been many accidents at sea due to the improper and inadequate use of such lasings.

The art has been searching out methods whereby bulk carriers can be transformed into container carriers. The general thrust in the art has been to try to improve permanent conventional lashings such as cables which are affixed both to the container and to the body of the ships. Mounts have been welded onto the decks of the holds of such ships to prevent movement of the bottom layer of the containers while the ship is in transit. Ideally to constrain the motion of stacked containers it would be best to employ a constraining apparatus which structurally becomes part of the ship's structure so as to achieve mutual enhancement thereof. Conventional means of lashing does not achieve this desirable result.

SUMMARY OF THE INVENTION

According to the present invention a bulk cargo carrier hold can be converted to a shipping container carrier by mounting at least one constrainer for maintaing the position of the container with respect to the walls of hold by removably mounting a bridge running between the walls of the hold on the walls of the hold and having at least one pair of chocks mounted on said bridge so spaced and adapted as to encompass at least a portion of each of the two sides of each container when a face of the container is brought in parallel alignment with the bridge. In a large hold a vertical series of individual bridges having chocks can be mounted on said hold walls to permit vertical stacking of containers and to constrain the motion thereof. Additional vertical series of individual bridges in parallel alignment with the first series can be employed so that additional rows of containers can be stacked head to head with respect to each other.

In the preferred embodiment of my invention the containers are normally not in direct contact with the bridge and chocks when the vessel is not listing. Further provision is made herein for the rapid removal of the bridges from the hold when it is desirable to reconvert the hold to bulk cargo storage. The chocks can be either fixedly or removably mounted on the bridge.

The bridge can be made of segments so that it can be folded when it is not used as part of the constrainer for ease of removal and storage. The means used for mounting the bridge on the walls can have means for creating tension between the bridge on the walls to assure proper alignment and to enable the bridge to be adapted to any warping of the vessel walls. In the preferred embodiment of this invention a bridge mounting means having an arm thereon is permanently swivelly mounted on the wall, the arm being composed of a tube permanently mounted at one end on a swivel fitting and having internal screw threads at the other end and a pipe having external screw threads at one end mateable with the internal screw threads of the tube portion of the arm and having means at the other end to removably connect it with the arm end of the bridge and the bridge means is made up of a series of interconnected rigid linear segments which can be folded up, the bridge means having a series of slots adapted to receive chocks at suitably spaced intervals.

This invention provides a constrainer for shipping containers for maintaining container position with respect to the walls of a vessel, said vessel having at least two walls in opposition to each other comprising, a first mounting means affixed to a first wall of the vessel, second mounting means affixed to a second wall of the vessel, said second wall of the vessel being in opposition to said first wall of the vessel, linear bridge means connectable to both the first mounting means and the second mounting means capable of running adjacent to a first side wall of a shipping container located in said vessel, chock means mounted on said bridge means capable of encompassing a portion of a second and a portion of a third side wall of the container to constrain lateral motion of the container with respect to the linear alignment of the bridge means.

DESCRIPTION OF THE PREFERRED EMBODIMENTS

Figure 1:
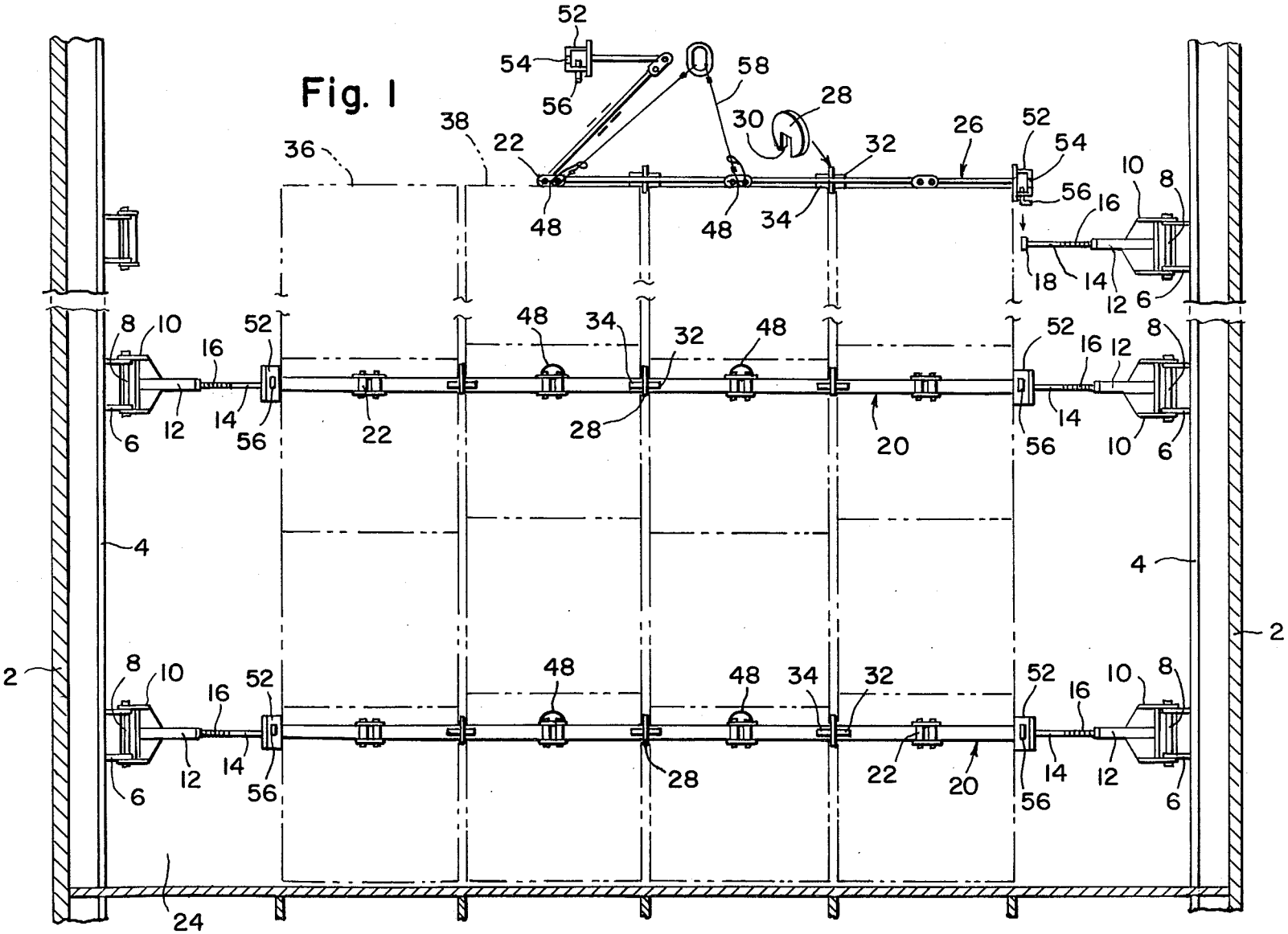
FIG. 1 is a partial section of a ship cargo hold giving face end view of stacked containers with constrainer assemblies shown both in an engaged and disengaged position.

A bridge mounting means is shown in FIG. 1, the walls 2 of a cargo hold having wall support beams 4 having a swivel fitting 6 permanently affixed to the wall support beam 4. An arm composed of a tube 12 having internal screw threads not shown, is screw mated to a rod 14 having external threads 16 at one end thereof. The other end of the tube 12 is mounted on fitting 10 which fitting 10 is rotatably mounted on a pin 8, which pin 8 is mounted in swivel fitting 6. A latch 18 is mounted on the outboard end of rod 14. This latch is used to engage the bridge means 20. This mounting means is preferred because it enables users of the constrainer shown to add tension to the bridge means 20 simply by screwing rod 14 into tube 12 and also provides a means for releasing such tension to facilitate removal of the bridge from the mounting means. The arm of the mounting means can be conveniently moved parallel to the wall 2 when it is not engaged with the bridge means 20 so as to facilitate and not interfere with the loading and unloading of bulk cargo.

While any conventional mounting means for mounting the bridge means 20 to the walls 2 can be usefully employed within the scope of this invention I have found that the advantages gained from the use of that shown in FIG. 1 are beneficial. The mounting means could be simplified by merely providing that the end of the bridge means 20 be bolted to the wall, or affixed to the wall by conventional male-female type grooved mateable fittings.

Figure 2:
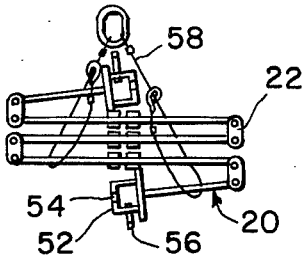
FIG. 2 is an upper detail view of a folded bridge means assembly attached to a cable sling for transport.

The bridge means 20 can be a solid bar which extends and is engagable with the outboard ends of a pair of mounting means mounted on opposite walls of the hold 24. In FIG. 1 a bridge means 20 is shown to be composed of a series of interconnected bar segments, with the segments being capable of being folded up accordian style as shown in FIG. 2 or with partial folding as shown in the top bridge means 26 shown in FIG. 1. The use of a segmented bridge means 20 facilitates removal and insertion of the bridge means from the vessel hold 24. The individual links of the bridge means 20 are linearly interconnected by means of a conventional swivel links 22 to permit such folding. Any type of linkage which will provide the desired motion and strength can be employed here.

In FIG. 1 the lower two bridge means 20 are shown in place and connected up to a wall beam supports and they are in vertical alignment with each other. The top bridge means 26 is lying on its side face. In the device as shown in FIG. 1, segmented bridge means 20 and 26 are shown. The segments shown are made of metal and have a vertical dimension which exceeds the thickness thereof. A chock means 28 is conveniently employed with such a bridge means 20. The chock means 28 is simply a circular disc of metal having a slot 30 therein to permit it to be slipped onto the bridge means 20 shown in FIG. 1. The chock means 28 has slot 30 which is compatible with the thickness of bridge means 20 and prevents the chock means 28 from rotating on bridge means 20 and gravity prevents it from falling off the bridge means 20. A pair of butts 32 and 34 on the bridge means 20 provides a slot on bridge means 20 for the chock means 28 to be slid onto the bridge means 20 and said butts 32 and 34 act to prevent chock means 28 from sliding laterally along bridge means 20.

The chock means 28 can of course be permanently affixed to the bridge means 20 by welding, etc., but in the preferred embodiment of the invention, we provide for removable chock means so that the bridge means can be folded into a smaller package for storage when not in use. The chock means 28 could also be mounted on the bridge means 20 with conventional mounting means such as a series of slots on the bridge means, etc., to allow for spatial adjustment of the internodal distances between the chocks should it be desired to use the constrainers of this invention with containers having varied widths. However, since most containers have widths of 8 feet and it is desirable to maintain a 3 inch separation between adjacent horizontal containers, it is simpler to provide for preset spacing of the chock means 28 on the bridge means 20.

As shown in FIG. 1, butts 32 and 34 can simply be pieces of flat metal rigidly affixed to one or both sides to the bridge means 20 by conventional methods such as welding, etc. Butt 32 is spaced apart from butt 34 a distance which is sufficient to permit the chock 28 to slide down upon the bridge means 20 by means of a slot 30 in the chock in the space between butts 32 and 34. When the chock 28 is so mounted on the bridge means, the butts 32 and 34 prevent lateral motion of the chock 28 lengthwise along the bridge means.

The bridge means 20 of my invention can have any cross sectional shape which will fit between the heads of the containers as they are stored in the vessel. It can be a pipe or have a triangular shape, it can be a solid metal or a hollow tube. It must be of sufficient strength to withstand the forces that will be applied to it in the situation in which it is being used. The bridge means 20 can even be a braided cable if so desired, but use of cable may be cumbersome to position down a slot provided by stacked containers.

Figure 3:
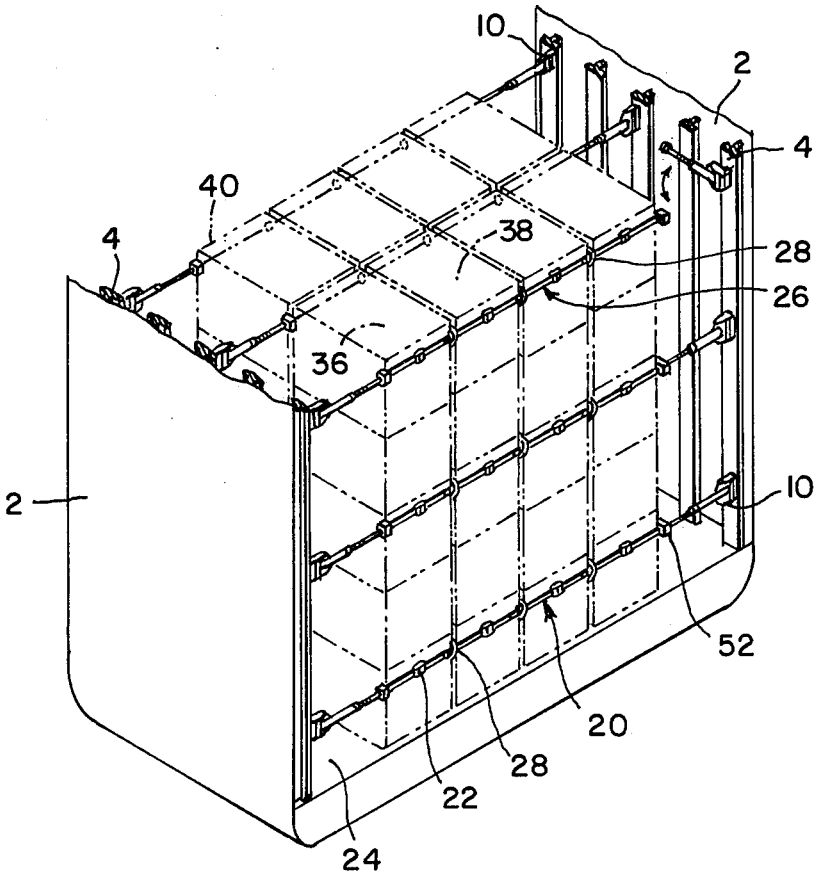
FIG. 3 is an isometric partial breakaway of cargo hold giving an isometric view of constrainer containers.

FIG. 3 shows the stacking of containers in a cut away segment of the hold of a ship. Containers 36 and 38 are stacked side by side. Chock means 28 has a portion which extends in between containers 36 and 38. When containers are stacked side by side in the hold of a ship, the normal spacing between such containers ranges generally between one inch and one and one half inches. In such instances we have found it useful to use a chock having a thickness of about three quarters of an inch between the containers. The allowance of play between the containers and the chock in such situations provides two benefits. First, it permits the bridge means 20 having chock means 28 mounted thereon to be easily dropped down between the containers after they have been stacked in a nested fasion as shown in FIG. 3 and thereafter the bridge means can be made taut by tensioning the pipe 16 in tube 12 located at each end of each bridge means as shown in FIG. 3. Secondly the play between the chock 28 and the containers 36 and 38 allows for normal anti-rack strength in each of the containers to be utilized before the constrainer is required to limit lateral motion of the containers it is constraining.

Racking of containers is a term of the art. When a container is on a moving basal plane which tilts from a horizontal position, tremendous forces are applied to the upper side of the container. When the portion of a ship as shown in FIG. 3 is rolling sidewise the containers stacked vertically are applying both dynamic forces to themselves and to each other. These forces tend to distort the shape of the containers. Containers are built with reinforcement means to resist such forces. The constrainers of this invention provide an additional advantage to users thereof in that they are designed to be utilized before the internal anti-racking resistance of the container is overpowered to prevent distortion of the shape of the containers due to rolling of the vessel sidewise.

The spacing on vessels of containers head to head as shown in FIG. 3 (see containers 36 and 40) generally provides for a space of three inches between the containers. The bridge means 20 itself will constrain the movement of containers fore and aft due to rocking of the containers from pitching and heaving of the vessel during transit. The thickness of the bridge means should allow play between the bridge means and the head to head spacing of the containers so that the anti-racking strength of the container can be utlized prior to its preventing further motion of the containers.

Conventional container interlocks can be advantageously employed to interlock the vertically stacked containers when the constrainers of this invention are employed. Exemplary of such type interlocks are shown in U.S. Pat. No. 3,752,511, issued Aug. 14, 1973 to Stanley Racy entitled "Container Coupler". Simple fast type interlocks to prevent lateral motion of vertically stacked containers with respect to each other also can be suitably employed. The bottom layer of the containers can be affixed to posts or mounts or container locks which are affixed to the vessel deck. This aids both in facilitating positioning of the containers when the novel constrainers of this invention are employed and prevents lateral movement of the base container of a vertical stack of containers.

To provide the utmost flexibility in the use of the novel constrainers of this invention to effectuate conversion of bulk cargo carriers to container carriers it is recommended that bridge mounting means 6 be spaced twenty feet three inches apart on center of the mounting means 6 so that both containers twenty feet long and containers forty feet long can be accomodated in the vessel. Furthermore, two twenty feet long containers can be linked together by using interlocks of the type and class shown in U.S. Pat. No. 3,972,439 issued Aug. 3, 1976 to John DiMartino entitled "Horizontal Connector for Shipping Containers". If such interlocks are used between the vertically stacked 20 foot containers a spacer plate should be inserted between such containers when they are placed on top of a forty foot container to prevent undue stress on the interlock between the twenty foot containers. It is well known to those skilled in the art that the so called conventional twenty foot long containers are really only nineteen feet ten and one half inches long so that the use of the interlock, as described in this paragraph, results in an overall body container length of forty feet when two so called twenty foot long containers are interlocked.

Studies have shown that conventional shipping containers can rack, that is to say have the upper side move laterally one and one half inches out of alignment with the bottom side without being permanently deformed. This racking movement tolerance is important when the constrainers of this invention are employed. It allows the container itself to internally absorb a tremendous amount of the thrust of the force when the vessel rolls before the constrainer is brought by the motion of the container into direct contact with the constrainer to restrain further movement of the container which if permitted to go unchecked, could result in severe damage to both the container and the vessel.

The exact amount of play between the constrainers and containers should take into account the ability of the container to withstand rocking forces when designing a system employing the novel constrainers of the invention.

Constrainer lift means 48 consisting merely of a hold on bridge means 26 or an eye welded thereon shown in FIG. 1 can be attached to the bridge means 20 so that cable sling 58 can be attached to the constrainer on the bridge means 26 to facilitate raising and lowering of the bridge means in the space between the containers and to remove the bridge means 20 from the hold when so desired. FIG. 2 shows the bridge means 20 in a folded state held by a cable sling 58. The cable sling 58 can be attached to a hoist to lift the bridge means 20 out of or into the hold of a ship.

The use of a segmented bridge means 20 as shown in FIGS. 1 and 2 permits the constrainers of this invention to be utilized when containers are stacked up to near the top of the hold by allowing the bridge means easy access into the hold when void space is limited.

In FIG. 1 a box-like lock fitting 52 is mounted on each end of the bridge means. The lock fitting 52 has a slot 54 therein adapted to receive the latch 18 of the mounting arm. A removable key 56 is screwably threaded into a hole in each fitting 52 so that when the latch 18 is properly engaged with the interior wall of the fitting 52 with rod 14 extending through slot 54 of lock fitting 52 and key 56 can be employed to lock the latch into such engagement to prevent the latch 18 from being withdrawn from the lock fitting 52. The key 56 can be used to effectuate disengagement also. Other conventional means for attaching the bridge means 20 to the mounting means exist and are within the scope of this invention and would be obvious to users thereof.

The exact number of constrainers to be in parallel alignment with eachother on a vertical plane will of course of dependant on the depth of the hold, the number of containers to be stacked vertically, the weights of the cargo and the amount of and degree of motion that will be encountered in use. Generally, it has been found advisable to employ constrainers for each horizontal layer of containers being piled up. This is especially true if container interlocks between containers vertically stacked upon each other are not employed. If sturdy interlocks are used in such cases then only one constrainer per two horizontal layers of containers need only be used, provided the cargo to be carried is not too heavy and very rough seas are not to be encountered.

As will be obvious to those skilled in the art, the devices disclosed herein provide great economics to users of these devices. Since adjacent stacks of containers will not require the use of conventional bridge interlocks, the wide variety and large number of locks required for use of prior art lashings are eliminated. Thus, where adjacent stacks of containers have heighth differentials, no specialized locks are required to accomodate such differential. The system can use a universal type interlock to vertically interlock corner fittings in each stack. This is not only a safety feature but provides economic benefits as well.

What is claimed is:

1. A constrainer for shipping containers for maintaining container position with respect to the walls of a vessel, said vessel having at least two walls in opposition to each other comprising:

(a) first mounting means affixed to a first wall of the vessel;

(b) second mounting means affixed to a second wall of the vessel, said second wall of the vessel being in opposition to said first wall of the vessel;

(c) linear bridge means connectable to both the first mounting means and the second mounting means capable of running adjacent to a first side wall of a shipping container located in said vessel;

(d) a plurality of chock means mounted on said bridge means capable of encompassing a portion of a second and a portion of a third side wall of the container to constrain lateral motion of the container with respect to the linear alignment of the bridge means.

2. The constrainer of claim 1 wherein additional chock means are mounted on said bridge means to constrain additional containers in spaced apart relationship to each other.

3. The constrainer of claim 2 wherein the chock means are removably mounted on the bridge means.

4. The constrainer of claim 3 wherein the chock means are fixidly mounted on the bridge means.

5. The constrainer of claim 4 wherein the bridge means is comprised of a series of rigid linear segments rotatably mounted at the ends thereof to permit folding the bridge means.

6. The constrainer of claim 5 wherein the mounting means each have a linear arm projecting therefrom one end of said arm being capable of engaging an end of the bridge means and the other end of said arm swivelly mounted on the wall of the vessel.

7. The constrainer of claim 6 wherein the arm contains adjustment means to fixedly adjust the length of the arm.

8. The constrainer of claim 7 wherein the adjustment means is composed of a tube at one end thereof and a pipe screw threadably mounted in the tube at the other end thereof.

* * * * *